United States Patent [19]

Hawk

[11] Patent Number: 5,040,637

[45] Date of Patent: Aug. 20, 1991

[54] LIFT ASSEMBLY

[75] Inventor: Marion N. Hawk, Gladstone, Mo.

[73] Assignee: VBM Corporation, Louisville, Ky.

[21] Appl. No.: 480,881

[22] Filed: Feb. 16, 1990

[51] Int. Cl.[5] ..... B66F 7/28

[52] U.S. Cl. ..... 187/8.5; 187/8.72

[58] Field of Search ..... 187/8.41, 8.47, 8.49, 187/8.5, 8.54, 8.57, 8.71, 8.72

[56] References Cited

U.S. PATENT DOCUMENTS

| | | | |
|---|---|---|---|
| 2,201,179 | 5/1940 | Jackson et al. | 187/8.5 |
| 3,317,004 | 5/1967 | Harrison | 187/8.5 |
| 3,330,381 | 7/1967 | Halstead | 187/8.5 X |
| 4,573,552 | 3/1986 | Aoki | 187/8.72 X |
| 4,724,875 | 2/1988 | Baldwin et al. | 187/8.72 X |

*Primary Examiner*—Joseph E. Valenza

*Assistant Examiner*—Dean A. Reichard

*Attorney, Agent, or Firm*—Fay, Sharpe, Beall, Fagan, Minnich & McKee

[57] ABSTRACT

A lift assembly includes four swing arms interconnecting a base member and lift platform. A hydraulic cylinder selectively elevates the lift platform relative to the base member. A stiff leg also extends between the base member and the lift platform and cooperates with a series of stop blocks for locking the lift platform at predetermined heights above the base member. A link is associated with the stiff leg to selectively support the stiff leg above the stop blocks and permit an operator to move the lift platform between the predetermined heights. The link automatically positions the stiff leg for engagement with the stop blocks if the direction of movement of the platform is altered.

23 Claims, 6 Drawing Sheets

LIFT ASSEMBLY

BACKGROUND OF THE INVENTION

This invention pertains to the art of lift assemblies and more particularly to lift assemblies for elevating automotive vehicles above the ground surface for servicing and repair.

The invention is particularly applicable to a four bar linkage lift assembly and will be described with particular reference thereto. However, it will be appreciated that certain aspects of the invention have broader applications and may be advantageously employed in other environments and applications.

Prior lift devices oftentimes employ two pairs of swing arms interconnecting a base member and a lift platform. The swing arms are disposed on opposite sides of the base member and lift platform, and pivotally secured thereto. One or more hydraulic cylinders elevate the lift platform to selected heights above the base member to permit a mechanic to work on a vehicle raised by the platform. This arrangement is commonly known as a four bar linkage lift assembly.

Typically a stiff leg extends between the base member and lift platform to provide a back-up or safety locking arrangement should any problems arise with the hydraulic cylinder once the platform has been raised. One end of the stiff leg is pivotally secured to the lift platform while the opposite end is adapted for selective sliding movement along the base member. Raised stops or locking members are provided on the base member to cooperate with the stiff leg and prevent inadvertent descent of the lift member relative to the base member.

According to one lift device of this type, the lift platform is a generally rectangular member that is adapted to engage the vehicle at an area between the front and rear axles. For example, a series of rubber pads or "bricks" are positioned on the platform to define the points of contact with the underside of the vehicle. The higher, though, the platform is elevated, the longer the swing arms must be to provide this increased height. In turn, the rear wheels of certain vehicles will therefore have a tendency to impinge on the rear swing arms that extend axially beyond the platform. The problem with such an arrangement is that as the platform is raised, the vehicle may have a tendency to move or roll because of the contact between the rear wheels and the rear swing arms.

Shortening the axial length of the platform encounters the problem that the center of gravity of large wheel base vehicles could extend beyond the surface area of the platform if the operator is not careful in positioning the vehicle over the platform. Thus, there is a tradeoff between the size of the platform, the goal of raising the platform to a predetermined height, the length of the swing arms, and the ability to accommodate as many different size vehicles as possible.

Another characteristic of lift assemblies of this type is that preferably the two front swing arms are folded or stored beneath the lift platform when the platform is in a lowered or down position. This is useful from the standpoint that those swing arms are protected by the lift platform in a lowered position. On the other hand, the height of the lift assembly in its lowered position must be minimized so that it does not interfere with the undercarriage of an automotive vehicle that is driven over the lift assembly to prepare the vehicle for lifting. Minimizing the height, though, restricts the initial lifting ability of the hydraulic cylinder since it must operate through extremely small angles. Thus, a difficult tradeoff exists between the storage of the swing arms, the height requirements, and the lift capabilities of the design.

Another lift device of this general type uses an elongated member that fits laterally between the wheels of the vehicle. The member is sized to permit the wheels of an associated vehicle to straddle either side of the elongated member and the wheel base dimension between the front and rear wheels is not the limiting factor. Dimensional tradeoffs, though, exist with this type of lift device. Particularly, the elongated member is sensitive to the lateral dimension between the insides of the tires.

It is still desirable, though, to engage the underside of a vehicle at selected points with this type of lift device. That is, the undercarriage is not directly engaged but rather it has been deemed desirable to provide an adjustable frame engaging member so that different frame points on various vehicles can be universally accepted.

Another problem associated with lift assemblies of these types is associated with changing the elevated height of a vehicle. For example, if the vehicle is elevated approximately 30 inches above the ground surface and it is desired to lower the vehicle to an intermediate height, currently available lift assemblies require that the platform be completely lowered before it is elevated again to an intermediate height. Of course, this is cumbersome for the lift operator o mechanic to follow this process.

It has thus been deemed desirable to provide a lift assembly that overcomes these various problems and provides a suitable tradeoff between these seemingly incompatible requirements.

SUMMARY OF THE INVENTION

The present invention contemplates a new and improved lift assembly that overcomes all of the above referred to problems and others and provides a compact, safe, yet effective lift assembly.

According to a more limited aspect of the invention, the lift assembly includes a base member and a lift platform that is selectively raised relative thereto. A linkage assembly interconnects the base member and lift platform wherein one pair of swing arms or legs are disposed laterally inward from the other pair of legs.

According to a further aspect of the invention, the lift platform has a longitudinal dimension not exceeding a predetermined minimum wheel base dimension.

According to a still further aspect of the invention, means are provided for lowering the lift platform from an elevated position to an intermediate height without completely lowering the platform.

According to another aspect of the invention, frame engaging members may be adjustable positioned around the lift platform.

A principal advantage of the invention is the ability to raise a maximum range of automotive vehicles to a predetermined height.

Another advantage of the invention resides in the ability to eliminate the rolling problem for selected vehicles associated with contacting the swing arms.

Yet another advantage of the invention is found in the simplified operation of the lift assembly.

Still another advantage of the invention resides in the compactness of the arrangement.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred and alternate embodiments of which will be described in detail in the specification and illustrated in the accompanying drawings which form a part hereof, and wherein.

DETAILED DESCRIPTION OF THE PREFERRED EMBODIMENTS

Figure 1:
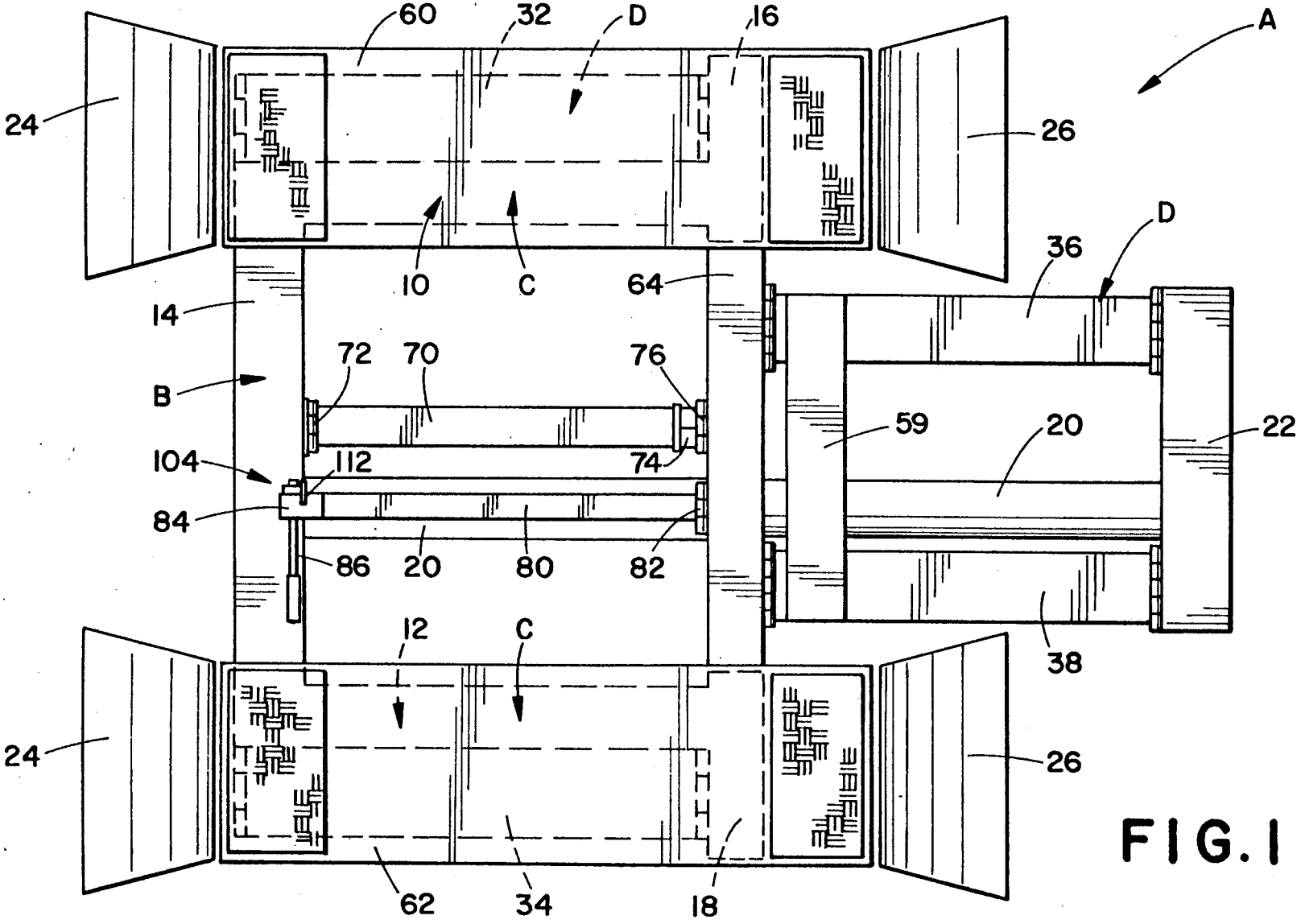
FIG. 1 is a top plan view of the subject invention.

Referring now to the drawings wherein the showings are for purposes of illustrating the preferred embodiments of the invention only and not for purposes of limiting same, the FIGURES show a lift assembly A having a base member B and lift platform C interconnected by a swing arm assembly D adapted to raise or elevate a vehicle (not shown) above the base member.

More particularly, and with reference to FIGS. 1 and 2A–D, the base member includes first and second longitudinal members 10, 12 disposed beneath the lift platform and thus denoted by dashed lines in FIG. 1. Further, a first lateral member 14 extends between first ends of the members 10, 12 to define a generally U-shaped configuration. Opposite ends of the members 10, 12 are integrally secured to second and third lateral members 16, 18. Another longitudinal member, defined by third longitudinal member 20, extends axially outward from the first lateral member at an area disposed approximately midway between the members 10, 12. The opposite end of the third longitudinal member is likewise integrally secured to a fourth lateral member 22. These longitudinal and lateral members 10–22 substantially define the base member B and are secured to the ground or garage floor by suitable fastening means (not shown).

The base member also includes longitudinally spaced ramp pairs 24 at one end and 26 at the other end. The ramps permit a vehicle to be driven over the lift platform and allow the wheels to traverse the elevation from the ground surface to the lift platform with ease. Although the maximum height of the ramps, and likewise the lift platform, is approximately four inches, the ramps facilitate driving a vehicle over the lift assembly and eliminate damage thereto.

The swing arm assembly D includes four swing arms or legs disposed in pairs 32, 34 and 36, 38. The first pair of legs 32, 34 are disposed at one end of the lift assembly beneath the lift platform at areas laterally outward from respective first and second longitudinal members 10, 12. Accordingly, the legs 32, 34 are also denoted by dashed lines in FIG. 1. First or upper ends 42, 44 of the first leg pair pivotally engage the lift platform C, specifically being hinged to the lift platform. Second or lower ends 46, 48 of the first leg pair pivotally engage the base member B at the second and third lateral members, respectively. In a similar manner, the third and fourth legs 36, 38 have first or upper ends 52, 54 that pivotally engage a transverse member of the lift platform C. Second or lower ends 56, 58 likewise pivotally engage the base member B at the fourth lateral member 22. The third and fourth legs are rigidly interconnected by a cross member 59 adjacent the upper ends 52, 54 to provide further stability to the arrangement.

The lift platform C includes in this embodiment first and second longitudinal members or plates 60, 62. Preferably, these plates have a transverse or lateral dimension that is greater than the combined lateral dimension of the members 10, 12 and the first and second swing arms 32, 34. Stated in another manner, the plates overlie and protect the first swing arm pair and the first and second longitudinal members 10, 12. Additionally, an interconnecting or transverse member 64 maintains the spaced relationship between the plates and provides a region for connecting component parts of the lift assembly as will become more apparent below.

As best illustrated in FIG. 1, the third and fourth legs are disposed laterally inward from the first and second legs. This permits the third and fourth legs to extend longitudinally or axially beyond the lift platform and still permit elevation of the platform to a predetermined height of, for example, 30 inches. If such an accommodation is not made, the ability to elevate a vehicle having a minimal wheel space of approximately 55 inches is constrained. According to the subject arrangement, though, moving the third and fourth legs laterally inward prevents any interference with driving the vehicle over the platform, yet still permits a 30 inch elevation of the platform.

Figure 2A:
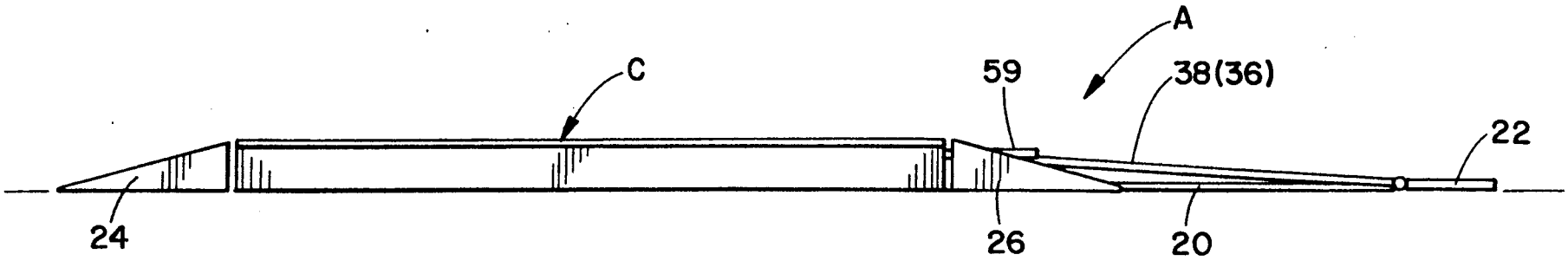
FIG. 2A is a side elevational view of the lift assembly of FIG. 1 in a lowered position.

Turning again to FIGS. 2A–2D, the operation of the four bar linkage lift assembly is best illustrated. In FIG. 2A, the lift assembly is shown in a lowered or collapsed position. The overall height of the lift platform relative to the ground surface is maintained at approximately 4 inches. It has been found that any greater height can potentially result in problems with the undercarriages of certain vehicles. Unfortunately, with such low heights, it is difficult to elevate heavy vehicles through use of hydraulic cylinders that fit within the space criteria. Prior arrangements use a cylinder that easily fits within the four inch space, mounted at a slightly canted angle. The canted mounting of the cylinder is necessary to achieve initial lifting since an absolute horizontal disposition of the cylinder would not result in any extension of the cylinder and likewise no lifting of the platform.

According to the subject invention, though, the largest diameter cylinder that will fit within the 4 inch constraint is utilized. The larger cylinder, though, is eccentrically mounted using the smallest pivot pins possible. In other words, the cylinder is actually disposed in a substantially horizontal position but the forces act through diametrically opposite edges of the cylinder. The mounting regions of the cylinder with the base member at one end and the lift platform at the other end are offset relative to the longitudinal axis of the cylinder. These mounting regions are also diametrically opposed to one another.

Although the smaller cylinder used in prior devices may reach a predetermined lift capacity of, for example, 7,000 pounds at a lower height than the subject invention, the smaller cylinder maximizes out and the length of the arm or cylinder rod is also shorter. The eccentric cylinder, though, results in a greater lift height while maintaining the lift capacity.

According to the subject invention, a predetermined lift capacity of 7,000 pounds is achieved at only a slightly greater height. The advantages, though, of the larger cylinder are then realized since the larger cylinder can elevate much larger loads. Thus, by eccentrically mounting a larger cylinder, all the benefits of the prior arrangement are realized and even greater loads can be efficiently handled. Eccentric mounting merely results in the pivot points of the cylinder defining a line of action that is canted or angled with respect to the axis of the cylinder.

Thus, and as illustrated in FIGS. 2A–2D, a hydraulic cylinder 70 is pivotally secured at one edge 72 to the first lateral member 14 of the base member while the rod 74 is secured at edge 76 (FIG. 1) to the transverse member 64 of the lift platform. As is well known in the art, by supplying hydraulic pressure to the head end of the cylinder, the rod 74 is extended and the lift platform swings upwardly relative to the base member. The swing arms or legs 32, 34, 36, 38 define a parallelogram arrangement and maintain the lift platform in a horizontal position as it is raised relative to the base member.

A locking leg or stiff leg 80 is pivotally secured at one end 82 to the transverse member 64 of the lift platform C. The opposite end 84 moves along the third longitudinal member 20 of the base member from left to right as illustrated in FIGS. 2A–2D as the hydraulic cylinder is extended and the lift platform is raised. With additional reference to FIG. 3, the second end 84 of the stiff leg includes an arm 86 that is welded to a nose 88 of the stiff leg. The arm is of a predetermined diameter adapted to cooperate with stop blocks 94, 96, 98 that are longitudinally spaced along the base member.

Figure 2B:
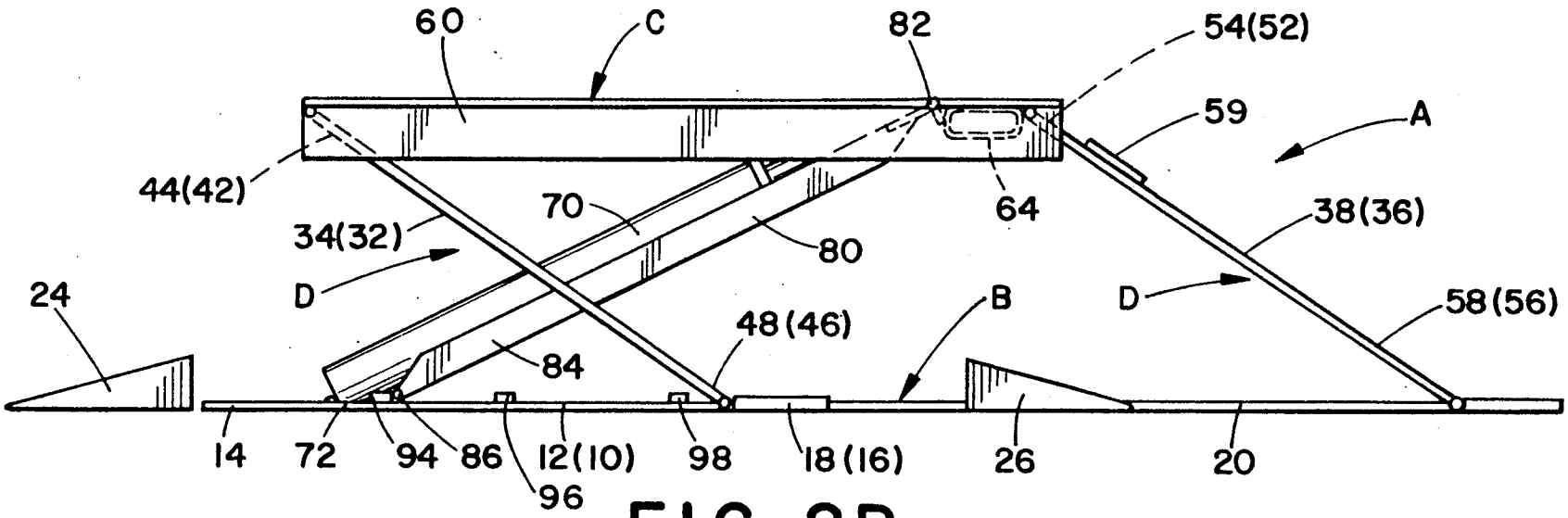
FIG. 2B is a side elevational view of the lift assembly of FIG. 1 in a first intermediate locked position.
Figures 2C, 2D:
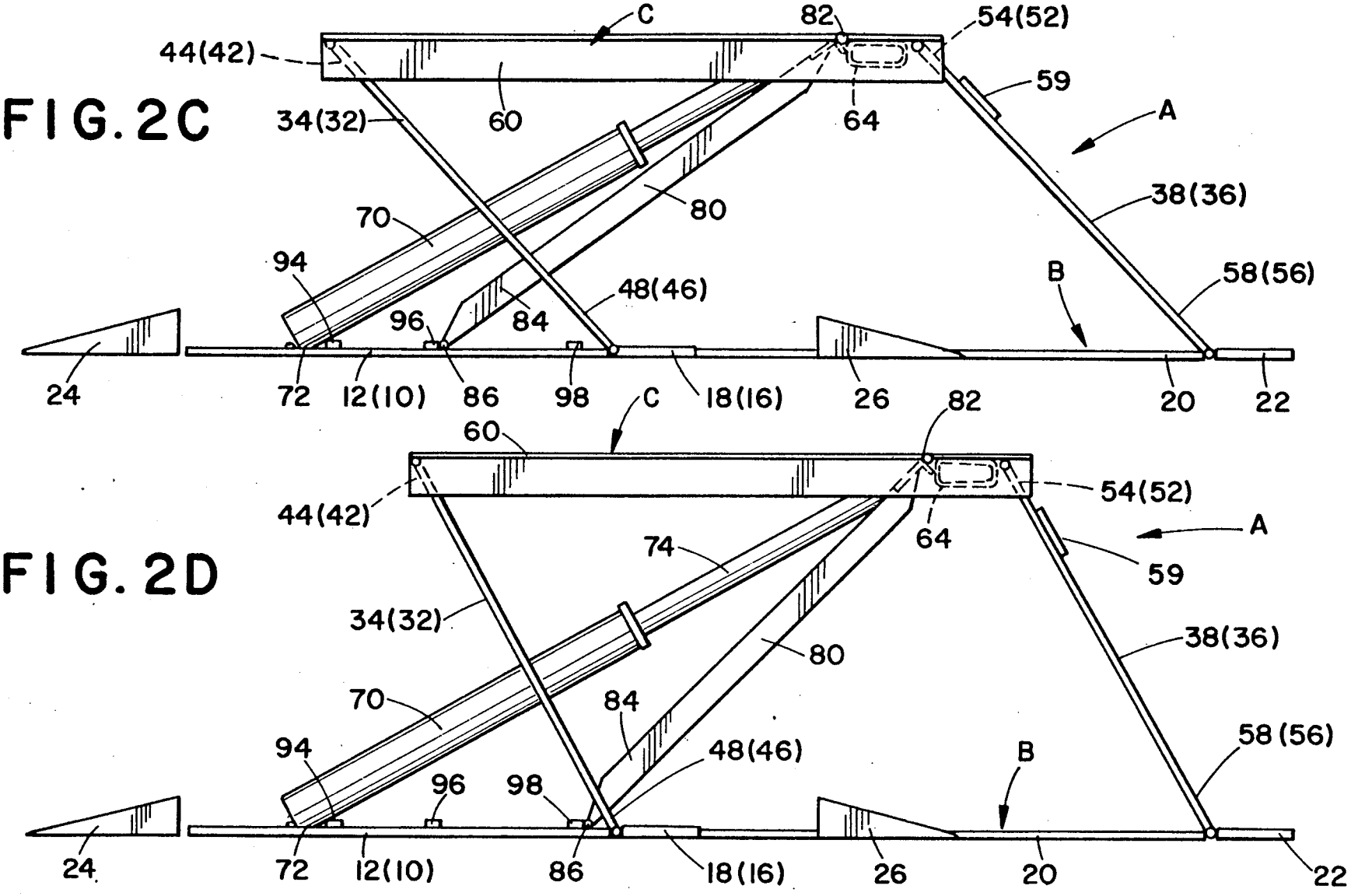
FIG. 2C is a side elevational view of the lift assembly of FIG. 1 in a second intermediate locked position.
FIG. 2D is a side elevational view of the lift assembly of FIG. 1 in a third locked or fully raised position.

As illustrated in FIG. 2B, the second end 84 of the stiff leg, in particular the arm 86, abuttingly engages the stop block 94 to provide a safety lock or back-up should any difficulties arise with operation of the hydraulic cylinder. The stiff leg is capable of fully supporting the automotive vehicle without any assistance from the hydraulic cylinder, if necessary. Further, the stop block 94 is disposed at a predetermined location along the base member B so that the lift platform is, in turn, raised a predetermined height above the base member, for example, 20 inches. Similarly, stop block 96 is located so that the lift platform is elevated approximately 25 inches above the base member (FIG. 2C) while stop block 98 maintains the lift platform approximately 30 inches above the base member (FIG. 2D). Of course, one skilled in the art will understand that other dimensional relationships could be utilized without departing from the scope and intent of the subject invention. Further, a greater or lesser number of stop blocks could be employed if a different number of predetermined heights were desired.

Figure 3:
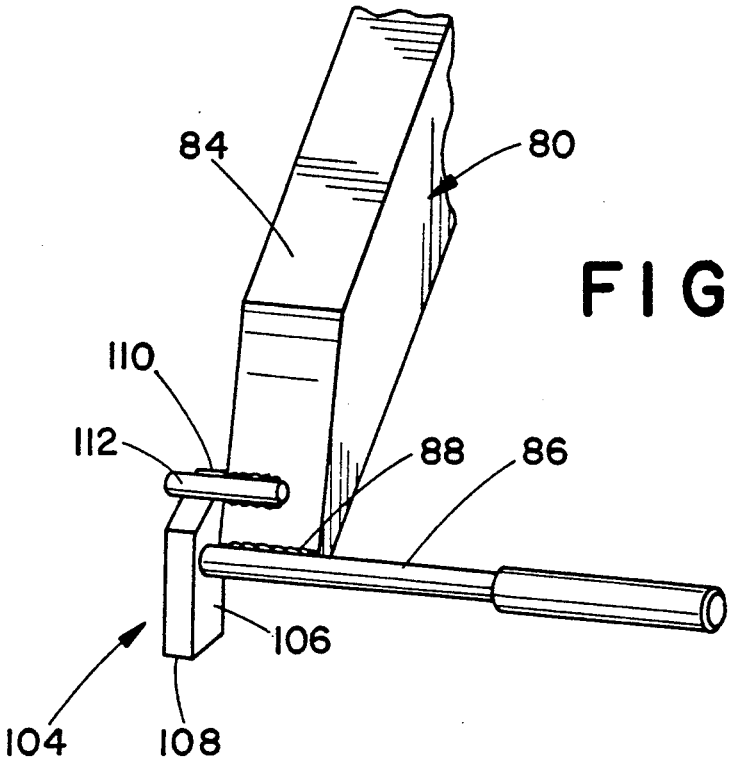
FIG. 3 is a perspective view of one end of the stiff leg.
Figure 4:
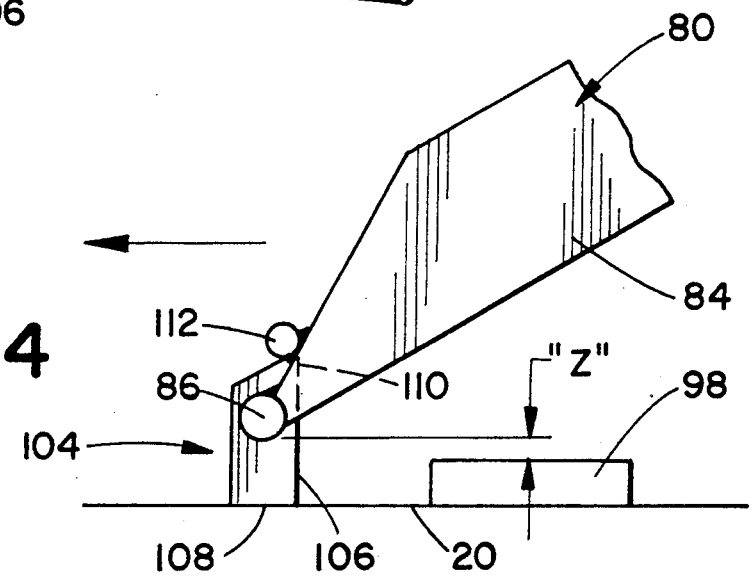
FIG. 4 is a side elevational view illustrating the link in an upright position so that the stiff leg will clear a stop member.
Figure 5:
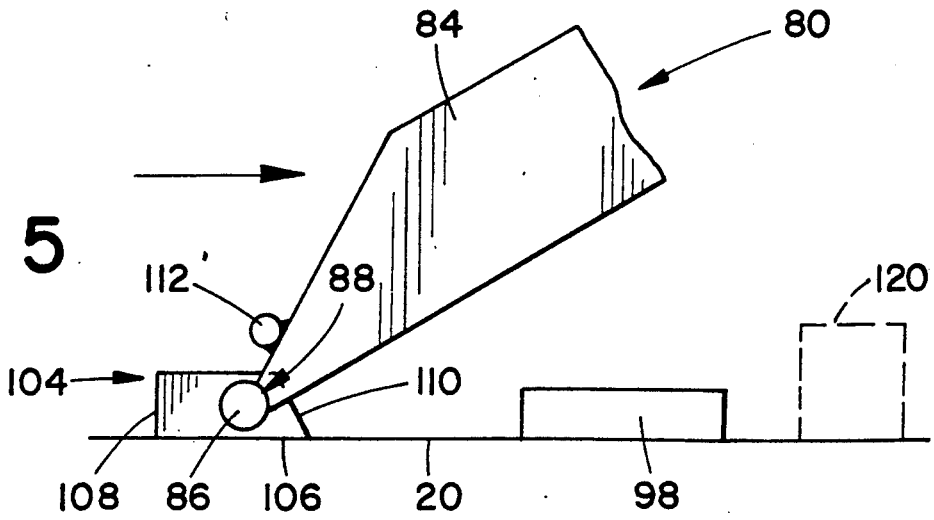
FIG. 5 is a side elevational view particularly illustrating the link in a down position so that the stiff leg engages a stop member.

As illustrated in FIGS. 3–5, the subject lift assembly employs an irregularly shaped link 104 that facilitates movement of the lift platform between the different predetermined heights illustrated in FIGS. 2A–2D. More specifically, the link 104 is pivotally secured to the stiff leg, and preferably pivots on one end of the arm 86. Typically, the link will assume the position shown in FIG. 5 where the elongated side 106 thereof is disposed in a horizontal position sliding along the longitudinal member 20 of the base member, and the short side 108 of the link is vertically disposed. In this position, the nose 88 of the stiff leg is adapted to engage any of the stop blocks 94, 96, 98. In this manner, the stiff leg can abuttingly engage one of the stop blocks and maintain the lift platform at a predetermined height as shown in FIGS. 2B–2D. For example, if the platform is being lowered and the stiff leg is moving leftwardly as viewed in FIG. 5, the nose will engage a stop block and halt further downward movement of the platform.

The platform can still be raised since the angular orientation of the stiff leg permits the nose to slide over a stop block until the stiff leg clears the right-hand edge of the stop block. In current lift assemblies of this type, a manual adjustment is necessary. To discourage a lift assembly operator from releasing the locking action of the stiff leg, the subject device simplifies the arming and disarming of the stiff leg. In the past, manual rotation of a comparable link was necessary to lower the platform. Thus if an operator was standing at the control panel of the lift assembly, he had to walk back and forth to manually rotate the link and disarm or disengage the safety feature of the stiff leg.

With the subject invention, though, if it is desired to clear the stop blocks, for instance when lowering the lift platform, the arm 86 is merely lifted and the link automatically rotates as a result of gravity to the position illustrated in FIG. 4. The centroid of the link is designed to facilitate a counter-clockwise rotation of the link about arm 86 when the arm is lifted so that side 106 is then vertically disposed and side 108 is horizontal. The counter-clockwise rotation of the link is stopped by toe 110 of the link engaging limit member 112 which is welded to the stiff leg. The arm 86 is thereby disposed a dimension "z" above the upper surface of any of the stop blocks 94, 96, or 98.

Once positioned as shown in FIG. 4, and as long as the stiff leg is moving leftwardly, the toe 110 will engage limit member 112 and the arm 86 and nose of the stiff leg will clear the top surface of the stop blocks. As soon as rightward motion of the end 84 of the stiff leg occurs, though, the coefficient of friction between side 108 and the base member is sufficient to rotate the link in a clockwise direction so that elongated side 106 again engages the base member. Thus, the stiff leg automatically becomes operative for selective engagement with one of the stop blocks merely by reversing direction of the platform, i.e. from lowering to raising the platform.

An additional block 120 (FIG. 5) can be provided rightwardly of block 98. The additional block is preferably of greater height than the remaining blocks. In this manner, as the stiff leg moves in a rightward direction as shown in that FIGURE, the nose 88 will be raised sufficiently so that the link will rotate to the upright position shown in FIG. 4. In this manner, an operator of the lift assembly can have the lift platform at the highest predetermined height, and descend to the collapsed position as shown in FIG. 2A merely by further raising the platform so that the stiff leg is lifted by the additional block 120. The link thereby rotates and leftward motion of the stiff leg, which occurs as the lift platform descends, can continue since the nose clears the stop blocks. Also, if desired, an operator can actuate or arm the stiff leg at any intermediate position merely by raising the platform again, i.e. moving the stiff leg end 84 rightwardly, so that the link rotates in a clockwise manner.

Turning now to the FIGS. 6–8, the modified lift assembly A' has many of the same structural and functional features of the FIG. 1 embodiment described above and except as noted below. Therefore, for ease of illustration and description, like elements will be referred to by like numerals with a primed (') suffix and new elements will be identified by new numerals.

Figure 6:
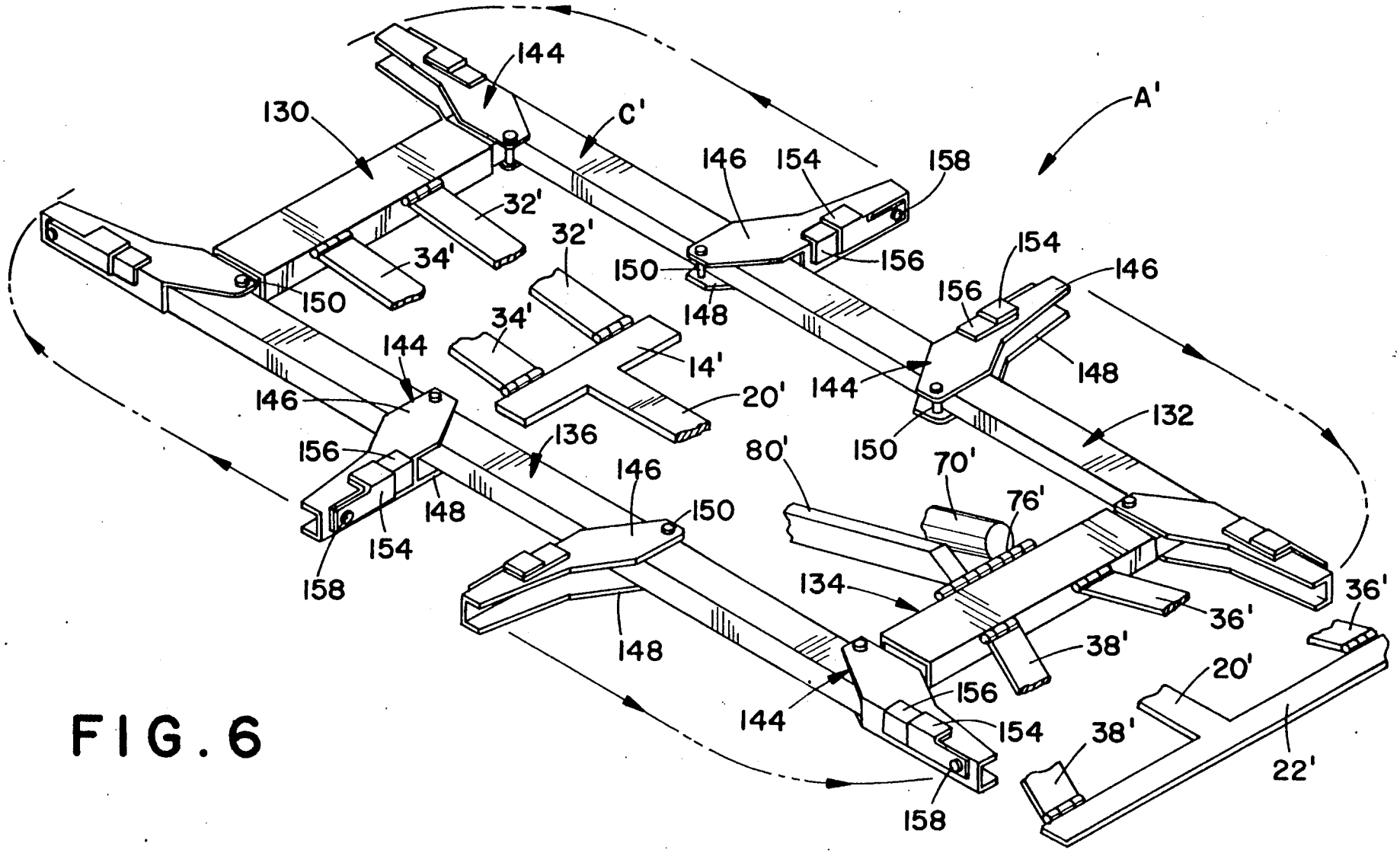
FIG. 6 is a perspective view of an alternative lift assembly showing the variable positioning of frame engagement arms about the periphery of the lift platform and schematically illustrating the base member.
Figure 7:
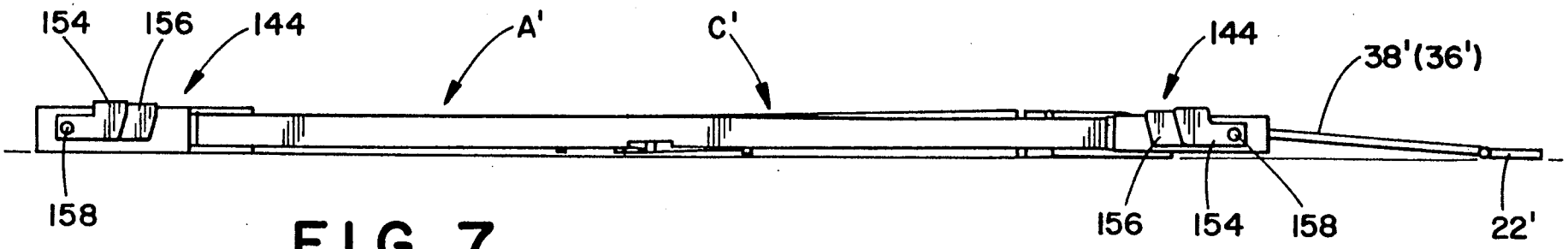
FIG. 7 is a side elevational view of the alternative embodiment of FIG. 6 in a collapsed position.
Figure 8:
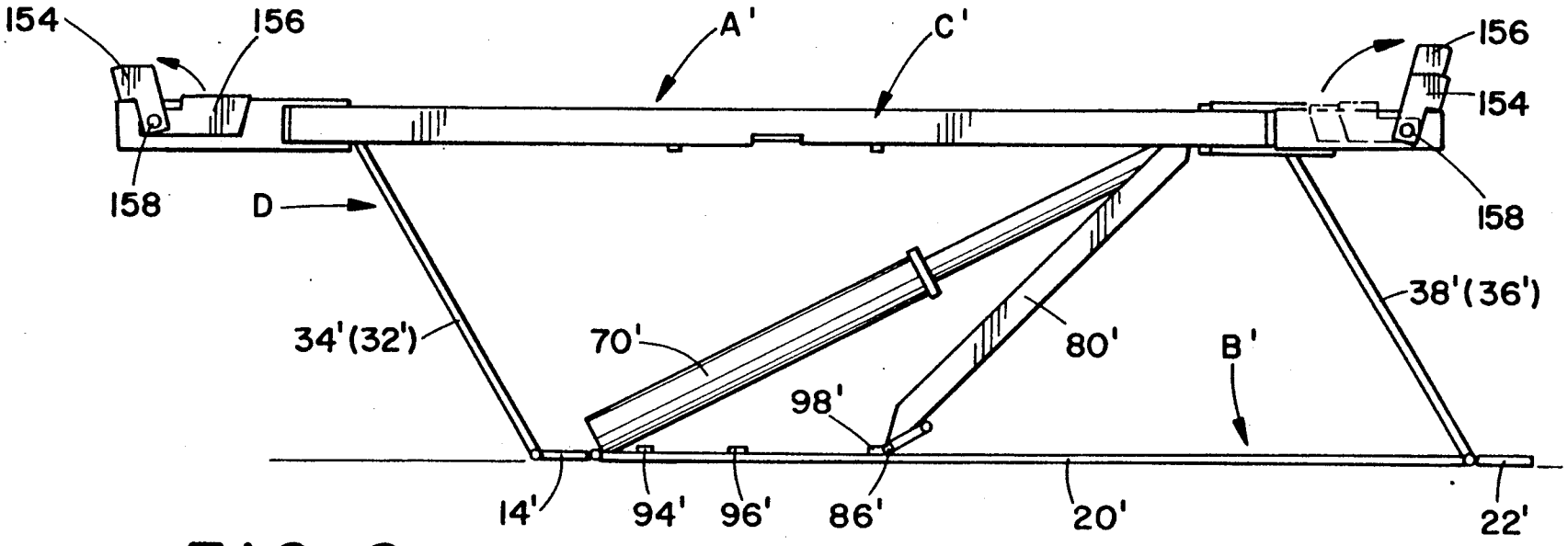
FIG. 8 is a side elevational view of the FIG. 6 embodiment in an elevated position, particularly illustrating operation of frame engagement members associated with the modified embodiment.

Whereas the lift assembly, particularly the lift platform, in the FIG. 1 embodiment is minimized in its longitudinal dimension for supporting a vehicle at an area longitudinally between the wheels, the lift assembly A' of FIGS. 6–8 is sensitive to the lateral dimension between the insides of the vehicle tires. Thus, the lift platform C' can be substantially elongated and is laterally narrowed relative to the previously described lift platform C.

The lift platform is defined by a rectangular frame assembly that includes frame members 130, 132, 134, 136 connected together, in this particular instance welded together (FIG. 6). The base member is also slightly modified and now defines a generally I- shaped configuration. The base member is partially broken away to provide an informal representation of its cooperation with the lift platform. In comparing the base member B' to the base member B, the first and second longitudinal members 10, 12 and the first and second lateral members 16, 18 are eliminated. This requires the swing arms to also be re-oriented in the modified embodiment.

Specifically, the swing arms 32', 34' are hinged to the first lateral member 14' but extend longitudinally forward, or in the opposite direction from the first swing arm pair orientation in the prior embodiment. These swing arms are also hinged to the frame member 130 and extend rearwardly therefrom.

The swing arms 36', 38' are hinged to outer ends of the lateral member 22' of the base member and angle laterally inward for pivotal connection with frame member 134. Likewise, the opposite ends of swing arms 36', 38' are hinged to frame member 134 at a laterally inward location. Otherwise, the swing arm pairs operate in substantially the same manner as described above. The hydraulic cylinder 70' and stiff leg 80' are also structurally and functionally the same.

Another modification to this embodiment is the use of frame engaging members 144 associated with the lift platform. Preferably, four frame engaging members are used, each being of identical construction so that description of one applies to the others. Particularly, each frame engaging member includes first and second flanges 146, 148 that are disposed in substantially parallel relation, one on top of the lift platform and the other beneath the lift platform. A pin 150 extends through the flanges at an area disposed inwardly of the frame members defining the lift platform. This arrangement permits each of the frame engaging members to be selectively moved through a perimeter portion approximating one-fourth of the platform. In this manner, the frame engaging members can be selectively positioned around a quadrant of the lift platform to accommodate various vehicles that recommend different points of engagement therewith.

First and second flip-ups or contact extensions 154, 156 are associated with each frame engagement and selectively rotate about pin 158. The first flip-up 154 may be pivoted around the pin 158 independently of the second flip-up 156. Therefore, if only the first flip-up is pivoted to an upright position as shown on the left-hand side of FIG. 8, a vehicle is supported only a short distance above the plane defined by the lift platform. Alternatively, both flip-ups may be pivoted upwardly as shown at the right-hand end of FIG. 8 to provide an increased height for supporting the vehicle above the frame members.

The invention has been described with reference to the preferred embodiments. Obviously, modifications and alterations will occur to others upon a reading and understanding of the specification. It is intended to include all such modifications and alterations insofar as they come within the scope of the appended claims or the equivalents thereof.

Having thus described the invention, it is now claimed:

1. A lift assembly comprising:
a base member;
a lift platform;
means for selectively raising the lift platform relative to the base member; and,
a four bar linkage interconnecting said base member and lift platform, said linkage including first, second, third, and fourth swing arms, each being pivotally connected at opposed ends to said base member and lift platform, respectively, said first and second swing arms being disposed laterally inward of said third and fourth swing arms.

2. The lift assembly as defined in claim 1 wherein said lift platform has a longitudinal dimension not exceeding a predetermined minimum dimension of approximately 55 inches.

3. The lift assembly as defined in claim 1 wherein the first and second swing arms are wholly confined between longitudinally opposed ends of the lift platform.

4. The lift assembly as defined in claim 3 wherein the third and fourth swing arms each have one end secured between the opposed ends of the lift platform and another end secured to the base member at an area outside the opposed ends of the lift platform.

5. The lift assembly as defined in claim 1 wherein the raising means is capable of selectively elevating the lift platform approximately 30 inches above the base member.

6. The lift assembly as defined in claim 1 further comprising means for locking the lift platform at preselected heights above the base member.

7. The lift assembly as defined in claim 1 further comprising frame engaging members associated with the lift platform for extending generally perpendicular relative thereto.

8. A lift assembly comprising:
a base member
a lift platform;
four swing arms interconnecting the base member and lift platform;
means for selectively elevating the lift platform to predetermined heights relative to the base member;

a stiff leg extending between the base member and the lift platform for limiting movement of the lift platform toward the base member;

stop blocks associated with the base member for locking the stiff leg against movement in one direction; and means for selectively raising the stiff leg to clear the stop blocks and permit the lift platform to move in a first direction toward the base member without engaging the stop blocks and for automatically lowering the stiff leg to engage the stop blocks in a second direction of movement of the lift platform away from the base member.

9. The lift assembly as defined in claim 8 wherein the elevating means is eccentrically mounted between the base member and the lift platform.

10. The lift assembly as defined in claim 8 further comprising frame engaging members operatively associated with the lift platform for being selectively positioned substantially perpendicular to the lift platform.

11. The lift assembly as defined claim 10 wherein the frame engaging members include first and second flip-ups for extending the frame engaging members to different heights above the lift platform.

12. The lift assembly as defined in claim 8 wherein the raising and lowering means includes a link having a first side that supports the stiff leg above the stop blocks.

13. The lift assembly as defined in claim 12 wherein the link includes a second side that supports the stiff leg below the stop blocks.

14. The lift assembly as defined in claim 13 wherein the link remains on its first side once positioned there as long as the lift platform is moved toward the base member.

15. The lift assembly as defined in claim 14 wherein the link moves from the first side to the second side as the lift platform is moved away from the base member.

16. A lift assembly comprising:

a base member;

a lift platform;

four swing arms interconnecting the base member and lift platform;

means for selectively raising the lift platform to predetermined heights relative to the base member, the raising means including an expansible fluid cylinder member having first and second ends, the first end being mounted to the base member along an edge of the cylinder member and the second end being mounted to the lift platform along a diametrically opposite edge of the cylinder so that the fluid cylinder is eccentrically mounted relative to its longitudinal axis; and a stiff leg extending between the base member and the lift platform for limiting movement of the lift platform toward the base member.

17. The lift assembly as defined in claim 16 further comprising stop blocks associated with the base member for locking the stiff leg against movement in a first direction.

18. The lift assembly as defined in claim 17 further comprising means for selectively positioning the stiff leg to clear the stop blocks and permit the lift platform to move in a first direction toward the base member, and to engage the stop blocks and prevent the lift platform from moving toward the base member.

19. A lift assembly comprising:

a base member;

a lift platform;

four swing arms interconnecting the base member and lift platform;

means for selectively elevating the lift platform to predetermined heights relative to the base member;

a stiff leg extending between the base member and the lift platform for limiting movement of the lift platform toward the base member; and frame engaging members operatively associated with the lift platform for being selectively positioned substantially perpendicular to the lift platform, each frame engaging member being movable relative to the lift platform along approximately one-fourth the perimeter of the lift platform to accommodate various vehicles.

20. The lift assembly as defined in claim 19 wherein the frame engaging members include first and second flip-ups for extending the frame engaging members to different heights above the lift platform.

21. The lift assembly as defined in claim 19 wherein the frame engaging members each include first and second spaced flanges having a pin extending therethrough for pivotal and translational movement of the frame engaging member relative to the lift platform.

22. A lift assembly comprising:

a base member;

a lift platform;

means for selectively raising the lift platform relative to the base member;

a four bar linkage interconnecting said base member and lift platform, said linkage including first, second, third and fourth swing arms each pivotally connected at opposed ends to said base member and lift platform, respectively, and said first and second swing arms being disposed laterally inward of said third and fourth swing arms;

means for locking the lift platform at preselected heights above the base member including stop blocks associated with the base member;

means for selectively releasing the locking means to lower the lift platform, the releasing means including a link having a first side for supporting the locking means above the top of the stop blocks and a second side for supporting the locking means below the top of the stop blocks; and an additional block disposed adjacent one end of the base member for automatically positioning the link on its first side.

23. The lift assembly as defined in claim 22 wherein the link is automatically positioned on its second side when the lift platform is raised relative to the base member.

* * * * *